US007372361B1

(12) United States Patent
Mealing

(10) Patent No.: US 7,372,361 B1
(45) Date of Patent: May 13, 2008

(54) RESTAURANT SERVICE MANAGEMENT SYSTEM

(76) Inventor: Robert Mealing, 1698 NW. 13th St., Unit 5, Boca Raton, FL (US) 33486

( * ) Notice: Subject to any disclaimer, the term of this patent is extended or adjusted under 35 U.S.C. 154(b) by 76 days.

(21) Appl. No.: 11/501,536

(22) Filed: Aug. 9, 2006

Related U.S. Application Data

(60) Provisional application No. 60/706,819, filed on Aug. 9, 2005.

(51) Int. Cl.
*G08B 5/00* (2006.01)

(52) U.S. Cl. ..... 340/286.09; 340/7.2; 340/332; 705/15

(58) Field of Classification Search ..... 340/286.09
See application file for complete search history.

(56) References Cited

U.S. PATENT DOCUMENTS 3,821,707 A 6/1974 Peters ..... 340/171
4,222,111 A * 9/1980 Sloan et al. ..... 340/286.09
4,777,488 A 10/1988 Carlman, Jr. et al. ... 340/825.72
6,366,196 B1 4/2002 Green et al. ..... 340/286.09
7,026,916 B2 * 4/2006 Alexander ..... 340/286.09
2004/0143503 A1 * 7/2004 Suthar ..... 705/15

* cited by examiner

*Primary Examiner*—George Bugg
(74) *Attorney, Agent, or Firm*—Goldstein Law Offices P.C.

(57) ABSTRACT

A restaurant service management system, for facilitating efficient communication between a customer and service staff in an establishment such as a restaurant. The service staff is equipped with a communication station having a display, and each customer is equipped with a signaling device in communication with the communication station. The signaling device has a service button, numbered push-buttons, a red colored LED, and a green colored LED. To request service, the customer presses the service button, signaling the communication station, and causing the red colored LED to flash. When the alert is acknowledged by service staff at the communication station, an acknowledgment signal extinguishes the red colored LED and causes the green LED to illuminate. When service personnel reach the customer, a code is entered using the numbered pushbuttons, the green LED is extinguished, and the system is reset.

3 Claims, 1 Drawing Sheet

RESTAURANT SERVICE MANAGEMENT SYSTEM

CROSS REFERENCES AND RELATED SUBJECT MATTER

This application claims priority from provisional patent application Ser. No. 60/706,819, filed in the United States Patent Office on Aug. 9, 2005.

BACKGROUND OF THE INVENTION

The invention relates to a restaurant service management system. More particularly, the invention relates to a system that facilitates communication between restaurant patrons and service staff.

In most cases restaurant patrons are in agreement about how service should be. In particular, customers want good service and are willing to tip well, and service staff (servers or waiters) want to provide good service and earn good tips. Unfortunately, what often stands in the way of realizing this common goal is poor communication.

When a customer's need arises, there is no telling what task the server might be currently engaged in. Whatever legitimate task the server is engaged in—whether taking the order of another table, bringing food or drink, or preparing an order in the kitchen—it simply feels to the customer that the server is being inattentive. While the customer is seeking the attention of the service staff, the customer is distracted from the meal and conversation with his or her companions. The busier the restaurant, the more likely the customer is to feel neglected. Unfortunately, even in the busiest of circumstances, the customer's need can likely to be attended to, if that need could simply be communicated to the server.

U.S. Pat. No. 3,821,707 to Peters discloses a waitress call system. U.S. Pat. No. 4,777,488 to Carlman, Jr. et al discloses a restaurant service request communication system. U.S. Pat. No. 6,366,196 to Green et al. discloses a restaurant waiter paging system.

While these units may be suitable for the particular purpose employed, or for general use, they would not be as suitable for the purposes of the present invention as disclosed hereafter.

SUMMARY OF THE INVENTION

It is an object of the invention to produce a system, which facilitates better service at a restaurant, and thus increases customer satisfaction, customer tips, and repeat patronage. Accordingly, the present invention improves communication between customers and service staff.

It is another object of the invention to provide a restaurant service management system allows customers to conveniently and efficiently communicate with the service staff. Accordingly, the service staff has a communication station with a display, and the customer has a signaling device. When the customer activates the signaling device, the communication display provides an appropriate indication, to notify the service staff that the customer requires assistance. When the alert is acknowledged at the communication station, an appropriate signal is returned to the signaling device, which in turn notifies the customer that the service staff has acknowledged their request for service.

It is a further object of the invention to efficiently route service requests to the appropriate service personnel. Accordingly, when the patron is seated, the signaling device is scanned or otherwise entered into the system, and associated with a particular server, and a table, zone, or area. Further, following activation by the customer, the alert is canceled by the service personnel entering an appropriate service identification code.

The invention is a restaurant service management system, for facilitating efficient communication between a customer and service staff in an establishment such as a restaurant. The service staff is equipped with a communication station having a display, and each customer is equipped with a signaling device in communication with the communication station. The signaling device has a service button, numbered pushbuttons, a red colored LED, and a green colored LED. To request service, the customer presses the service button, signaling the communication station, and causing the red colored LED to flash. When the alert is acknowledged by service staff at the communication station, an acknowledgment signal extinguishes the red colored LED and causes the green LED to illuminate. When service personnel reach the customer, a code is entered using the numbered pushbuttons, the green LED is extinguished, and the system is reset.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
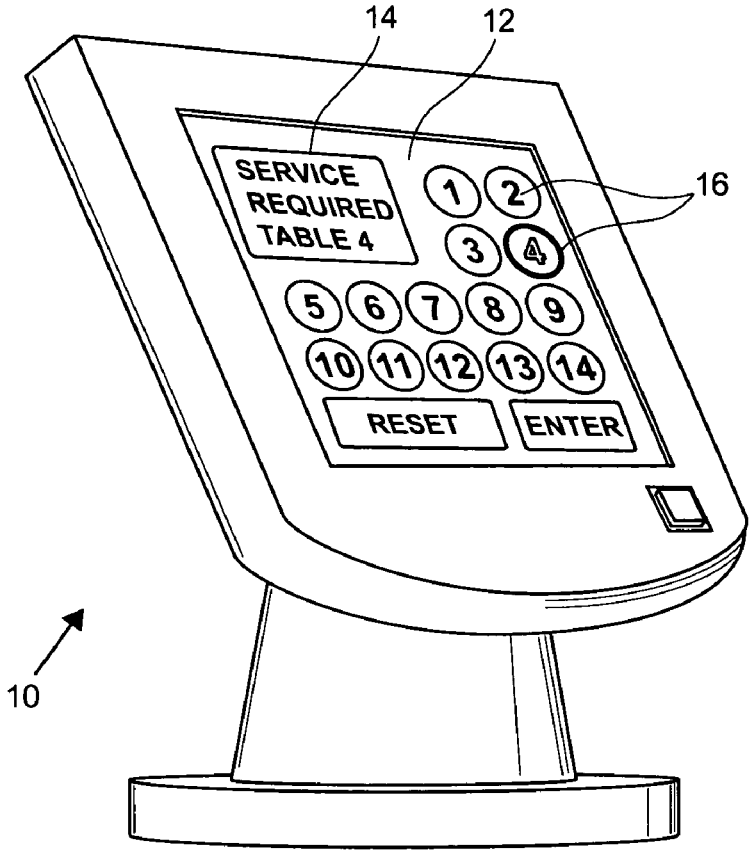
FIG. 1 is a diagrammatic perspective view, illustrating an example of the communication station for use by service personnel.

FIG. 1 illustrates a communication station 10 for use in an establishment that includes both customers and service personnel. The establishment may be a restaurant, hotel, resort, or the like. It should be noted that as used herein, "service personnel", "servers", "waiters", "service staff", are used interchangeably. The communication station includes a display screen 12 having a message location 14, and a plurality of customer indicators 16. Note that the display screen 12 is preferably a touch screen, such that service personnel using the communication station 10 can interact therewith by pressing the display screen 12 at appropriate locations.

Figure 2:
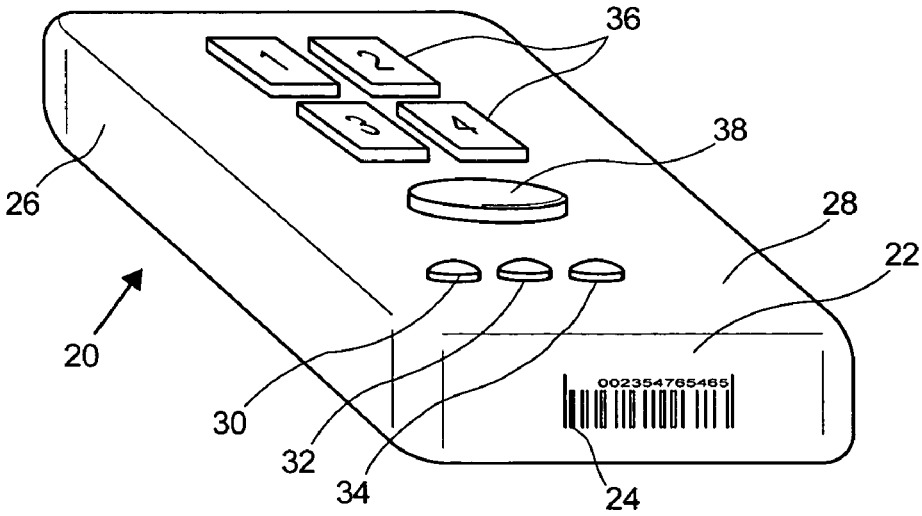
FIG. 2 is a diagrammatic perspective view, illustrating a signaling device, used by a customer to signal the communication station to alert service staff.

FIG. 2 illustrates a signaling device 20 for use in association with the communication station 10. In particular, each signaling device has a unique identification code 22, that may be encoded in barcode form 24. Each signaling device 20 is associated with a particular customer, includes a housing 26, having a top panel 28 having a red colored LED 30, a green colored LED 32, and a yellow colored LED 34. The top panel 28 also has a plurality of numbered pushbutton switches 36, and a service button 38.

In use, the signaling device 20 is initially associated with a particular customer by scanning the barcode 24 or otherwise entering the unique identification code 22 into the communication station 10. Once the customer has been seated, the communication station 10 may be appropriately updated with more specific information regarding that customer.

When the customer requires service, the customer presses the service button 38 on their signaling device 20. As the signaling device 20 transmits a signal to the communication station 10, the red colored LED 30 on the signaling device 20 begins flashing. Simultaneously, a message is displayed in the message location 14, such as "SERVICE REQUIRED TABLE 4", as illustrated in FIG. 1. Additional annunciators may be used to get the attention of service personnel, such as flashing one of the customer indicators 16 on the display 12.

Once service personnel have noticed the customer alert, the alert is acknowledged by pressing an appropriate customer indicator 16. An acknowledgment signal is transmitted to the signaling device 20, which ceases flashing the red LED 30, and illuminates the green LED 32. The customer is thereby acknowledged, and may relax in the knowledge that the service request has been heard by the service staff. It should be noted, that the person noticing and acknowledging the alert might be a different person than who actually subsequently attends to the needs of the customer. In particular, the communication station 10 might be staffed by a manager, host, or hostess, who in turn notifies another service staff member.

Then, when service personnel reaches the table associated with the customer, the service personnel cancels the alert by entering an appropriate service code into the signaling device 20 by pressing a predetermined combination of the numbered pushbutton switches 36 on the signaling device. At this point, the green colored LED 32 is extinguished, and the system is reset for future customer alerts.

It should be noted that the present invention may be configured, programmed or adapted to provide additional information useful to the efficient operation of the restaurant. In particular, information about orders, more detailed customer requests, and the like may be conveyed by the system, and reports regarding service efficiency can be generated.

In conclusion, herein is presented a restaurant service management system for facilitating efficient communication between restaurant customers and service staff. The invention is illustrated by example in the drawing figures, and throughout the written description. It should be understood that numerous variations are possible, while adhering to the inventive concept. Such variations are contemplated as being a part of the present invention.

What is claimed is:

1. A service management system, for use by customers and service personnel is communicating a request for service, comprising:

a communication station having a display screen having a message location and a plurality of customer indicators;

a signaling device, including a housing having a top panel having a red colored LED, a green colored LED, a plurality of pushbutton switches, and a service button; and wherein when one of the customers presses the service button, a signal is transmitted to the communication station, a message is displayed at the message location indicating that service is required by that customer, and the red colored LED is illuminated, when the service personnel acknowledges the message at the communication station an acknowledgment signal is transmitted to the signaling device which ceases flashing the red LED and illuminates the green LED, and when the service personnel reaches the customer and enters a service code into the signaling device using the pushbutton switches and the green LED is extinguished.

2. The service management system as recited in claim 1, wherein a plurality of signaling devices are each associated with a unique customer, each having a unique identification code, and each having a unique one of the customer indicators on the display screen associated therewith; and wherein when the communication station receives the signal from one of the signaling devices requesting service the customer indicator for that customer flashes on the display screen.

3. The service management system as recited in claim 2, wherein each signaling device has a barcode that is encoded with the unique identification code of said signaling device.

* * * * *